US011419396B2

(12) United States Patent
Xue et al.

(10) Patent No.: US 11,419,396 B2
(45) Date of Patent: Aug. 23, 2022

(54) WEARABLE DEVICE

(71) Applicant: GUANGDONG OPPO MOBILE TELECOMMUNICATIONS CORP., LTD., Guangdong (CN)

(72) Inventors: Yuege Xue, Guangdong (CN); Jianghua Hu, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 223 days.

(21) Appl. No.: 16/897,604

(22) Filed: Jun. 10, 2020

(65) Prior Publication Data

US 2020/0390202 A1 Dec. 17, 2020

(30) Foreign Application Priority Data

Jun. 17, 2019 (CN) ..... 201920911977.7

(51) Int. Cl.
*A44C 5/14* (2006.01)

(52) U.S. Cl.
CPC ..... *A44C 5/147* (2013.01)

(58) Field of Classification Search
CPC ..... A44C 5/147; A44C 5/14; G04B 37/16; G04B 37/1486
See application file for complete search history.

(56) References Cited

U.S. PATENT DOCUMENTS

2005/0265132 A1* 12/2005 Ho ..... A44C 5/14 368/282
2006/0180000 A1* 8/2006 Pernu ..... A44C 5/14 84/327
2018/0343986 A1 12/2018 Lukens et al.
2019/0361402 A1* 11/2019 Markan ..... A44C 5/14
2020/0154835 A1* 5/2020 Chen ..... A44C 5/147
2020/0405017 A1* 12/2020 Hu ..... A44C 5/0053

FOREIGN PATENT DOCUMENTS

CN 2580810 10/2003
CN 105310198 A 2/2016
CN 108552682 A 9/2018
(Continued)

OTHER PUBLICATIONS

IPI, Office Action for IN Application No. 202024024600, dated Jul. 30, 2021.

(Continued)

*Primary Examiner* — Jack W Lavinder
(74) *Attorney, Agent, or Firm* — Hodgson Russ LLP

(57) ABSTRACT

The present application relates to a wearable device, which includes a watchcase, a button, and a watchband. The watchcase is provided with a groove. The button is provided in the groove and can be moved to a first position and a second position relative to the watchcase. An end portion of the watchband is provided with a clamping groove extending to an edge of the watchband, the end portion can be received in the groove, and in the first position, the button passes through the clamping groove and engages the watchband with the watchcase, and in the second position, the button can be withdrawn from the clamping groove to enable the watchband to be detached from the watchcase.

15 Claims, 7 Drawing Sheets

(56) References Cited

FOREIGN PATENT DOCUMENTS

| | | |
|---|---|---|
| CN | 108552684 A | 9/2018 |
| CN | 207870446 | 9/2018 |
| CN | 109123933 | 1/2019 |
| CN | 210672315 U | 6/2020 |

OTHER PUBLICATIONS

WIPO, International Search Report for PCT/CN2020/095676, dated Sep. 16, 2020.
EPO, Extended European Search Report for EP 20179804.8, dated Oct. 21, 2020.

* cited by examiner

WEARABLE DEVICE

CROSS-REFERENCE TO RELATED APPLICATION

This application claims priority to Chinese Patent Application No. 201920911977.7, filed on Jun. 17, 2019, the entire disclosure of which is incorporated herein by reference.

TECHNICAL FIELD

The present application relates to the technical field of wearable devices.

BACKGROUND

Generally, watches include a watchband and a watchcase. The watchband uses an elastic thimble to engage with the watchcase. The elastic thimble is relatively thin, which makes it difficult to disassemble and assemble the watchband and the case.

SUMMARY

A first aspect of the present application provides a wearable device to solve the technical problem of inconveniences associated with disassembling and assembling a watchband and a watchcase.

The wearable device can include:

a watchcase provided with a groove;

a button provided in the groove and movable to a first position and a second position relative to the watchcase; and a watchband, wherein an end portion of the watchband is provided with a clamping groove extending to an edge of the watchband, the end portion can be received in the groove, in the first position, the button passes through the clamping groove and engages the watchband with the watchcase, and in the second position, the button can be withdrawn from the clamping groove to enable the watchband to be detached from the watchcase.

In the above-mentioned wearable device, the volume of the button can be set to be relatively large so that the user can exert force. The button can be moved to the first position and the second position relative to the watchcase, the watchband is locked in the watchcase when the button in the first position, and the watchband can be detached from the watchcase when the button is in the second position. Therefore, the wearable device with the above structure can easily detach the watchband from the watchcase.

In one of the embodiments, the watchcase is provided with a mounting groove communicating with the groove, and a part of a structure of the button is received in the mounting groove and exposed.

In one of the embodiments, the wearable device includes an elastic member, one end of the elastic member abuts against the watchcase, and the other end of the elastic member abuts against the button, and in the second position, the button compresses the elastic member.

In one of the embodiments, the watchband includes a main body and a stopper, the clamping groove includes a bottom groove and an opening communicating with the bottom groove, the bottom groove is located at the main body, the stopper is formed from a groove wall of the bottom groove, and the opening extends to an edge of the stopper; in the first position, the stopper restricts the button from coming out of the clamping groove.

In one of the embodiments, the button includes a connecting portion and a limiting portion connected to the connecting portion, a width of the connecting portion is smaller than a width of the limiting portion, and the elastic member abuts against the limiting portion; there are two stoppers, and the two stoppers extend toward each other to form the opening; a width of the opening is smaller than a width of the bottom groove, and a width of the limiting portion is greater than the width of the opening; in the first position, the stopper restricts the limiting portion from coming out of the clamping groove, and in the second position, the connecting portion can exit the clamping groove from the opening.

In one of the embodiments, in a thickness direction of the watchband, one side of the stopper is flush with a surface of the main body, and another side of the stopper opposite to the one side and the main body form a notch communicating with the bottom groove and the opening, the width of the limiting portion is less than or equal to a width of the notch, and in the second position, the limiting portion can exit the clamping groove from the notch.

In one of the embodiments, the limiting portion includes a body and a protruding cylinder connected to the body, the protruding cylinder extends in the thickness direction of the watchband, and the elastic member is sleeved on the protruding cylinder and abuts against the body.

In one of the embodiments, a groove wall of the groove is provided with a receiving groove, and an end of the elastic member away from the end of the body is received in the receiving groove and abuts against the watchcase.

In one of the embodiments, in the first position, an end of the protruding cylinder away from the body is received in the receiving groove.

In one of the embodiments, a groove bottom of the mounting groove is provided with a channel for communicating the mounting groove and the groove, a maximum width of the channel is smaller than a maximum width of the mounting groove, a maximum width of the limiting portion is greater than a maximum width of the channel, and the connecting portion passes through the channel and can move within the channel.

In one of the embodiments, in the first position, the elastic member is in a compressed state, and the elastic member causes the limiting portion to abut against a groove wall of the groove.

In one of the embodiments, the button includes a pressing plate connected to the connecting portion, the pressing plate and the limiting portion are respectively provided at two ends of the connecting portion, and in the first position, an exposed end surface of the pressure plate is flush with a surface of the watchcase.

In one of the embodiments, in a length direction of the watchband, one side of the pressing plate is flush with an end surface of one side of the connecting portion, and the other side of the pressing plate protrudes from an end surface of the other side of the connecting portion.

In one of the embodiments, the end portion of the watchband forms a curved surface on a side facing away from the watchcase, and in the first position, a circumferential edge of the curved surface is joined to a circumferential edge of a groove wall of the groove to form a continuous contoured surface.

In a second aspect of the present application, a wearable device can be provided to solve the technical problem of inconveniences associated with disassembling and assembling a watchband and a watchcase.

The wearable device includes:

a watchcase provided with a groove and a mounting groove communicating with each other;

a button disposed through the groove and the mounting groove and exposed from the mounting groove; and a watchband having a length direction and a thickness direction, wherein the watchband can be mounted to the groove along the length direction and be engaged with the watchcase by the button; and the button can retract into the mounting groove along the thickness direction of the watchband to enable the watchband to be detached from the watchcase.

In one of the embodiments, the watchband includes a main body and a stopper, the watchband is provided with a clamping groove, the clamping groove includes a bottom groove and an opening communicating with the bottom groove, and the bottom groove extends to opposite sides of the main body in the thickness direction of the watchband; the stopper extends from a groove wall of the bottom groove to form the opening, and the opening extends to an edge of the stopper in the length direction of the watchband; the watchband has a width direction, and in the width direction of the watchband, a width of the opening is smaller than a width of the bottom groove; when the watchband is engaged with the watchcase, the stopper restricts the watchband from coming out of the clamping groove in the length direction; and after the button is retracted into the mounting groove, the button can exit the clamping groove from the opening along the length direction of the watchband.

In one of the embodiments, the button includes a pressing plate, a connecting portion and a limiting portion, the pressing plate and the limiting portion are respectively connected to both ends of the connecting portion, and the pressure plate is exposed from the mounting groove; in the width direction of the watchband, a maximum width of the limiting portion is greater than a maximum width of the connecting portion; when the watchband is engaged with the watchcase, the stopper restricts the stopper from coming out of the clamping groove in the length direction of the watchband; after the button is retracted into the mounting groove, the connecting portion can exit the clamping groove from the opening.

In one of the embodiments, in the thickness direction of the watchband, one side of the stopper is flush with a surface of the main body, another side of the stopper opposite to the one side and the main body form a notch communicating with the bottom groove and the opening, a width of the limiting portion is less than or equal to a width of the notch, and after the button is retracted into the mounting groove, the limiting portion can exit the clamping groove from the notch.

In one of the embodiments, the wearable device includes an elastic member extending along the thickness direction of the watchband, one end of the elastic member abuts against the watchcase, and the other end abuts against the limiting portion; when the watchband is engaged with the watchcase, the elastic member causes the limiting portion to abut against the watchcase.

In one of the embodiments, the limiting portion includes a body and a protruding cylinder connected to the body, the protruding cylinder extends in the thickness direction of the watchband, and the elastic member is sleeved on the protruding cylinder and abuts against the body.

In one of the embodiments, the groove wall of the groove is provided with a receiving groove, an end of the elastic member away from the body is received in the receiving groove and abuts against the watchcase, and when the watchband is engaged with the watchcase, an end of the protruding cylinder away from the body is received in the receiving groove.

In one of the embodiments, a groove wall of the mounting groove is closed in a circumferential direction, and when the watchband is engaged with the watchcase, an exposed end face of the pressure plate is flush with an outer surface of the watchcase.

In one of the embodiments, a groove bottom of the mounting groove is provided with a channel for communicating the mounting groove and the groove, and the connecting portion passes through the channel; in the width direction of the watchband, a maximum width of the pressing plate and a maximum width of the limiting portion are larger than a maximum width of the channel.

In one of the embodiments, when the watchband is engaged with the watchcase, a circumferential side of the watchband and a circumferential edge of the groove wall of the groove join to form a continuous contoured surface.

In a third aspect of the present application, there is provided a wearable device, including:

a watchcase provided with a mounting groove along a first direction perpendicular to a surface of the watchcase and provided with a groove along a second direction perpendicular to the first direction of the watchcase, the mounting groove and the groove being mutually communicated;

a watchband, wherein an end portion of the watchband is receivable in the groove, and the end portion is provided with a U-shaped clamping groove extending along the first direction, and wherein the U-shaped clamping groove includes a groove bottom surface, and a first side wall and a second side wall opposite to each other, a first stopper and a second stopper respectively extend from the first side wall and the second side wall to an inside of the U-shaped clamping groove, a first distance is spaced between the first stopper and the second stopper, and lengths of the first stopper and the second stopper along the first direction are less than a length of the end portion along the first direction, and lengths of the first stopper and the second stopper along the second direction are less than lengths of the first side wall and the second side wall along the second direction respectively; and a button passing through the mounting groove and the groove of the watchcase and the U-shaped clamping groove of the watchband along the first direction, and being movable between a first position and a second position along the first direction, wherein in the first position, the button engages the watchband with the watchcase, and in the second position, the button is withdrawable from the U-shaped clamping groove to enable the watchband to be detached from the watchcase.

In a fourth aspect of the present application there is provided a watchband, wherein an end portion of the watchband is provided with a U-shaped clamping groove extending along a first direction of the watchband, and wherein the U-shaped clamping groove includes a groove bottom surface, and a first side wall and a second side wall opposite to each other, a first stopper and a second stopper respectively extend from the first side wall and the second side wall to an inside of the U-shaped clamping groove, a first distance is spaced between the first stopper and the second stopper, and lengths of the first stopper and the second stopper along the first direction are less than a length of the end portion along the first direction, and lengths of the first stopper and the second stopper along a second direction of the watchband are less than lengths of the first side wall and the second side wall along the second direction respectively.

BRIEF DESCRIPTION OF THE DRAWINGS

In order to explain the technical solutions in the embodiments of the present application or the related art more clearly, the drawings used in the description of the embodiments or the related art will be briefly introduced below. Obviously, the drawings in the following description are merely some embodiments of the present application. For those of ordinary skill in the art, other drawings can be obtained according to these drawings without paying creative labor.

DETAILED DESCRIPTION

In order to facilitate understanding of the present application, the present application will be described more fully with reference to the related drawings. The drawings show the preferred embodiments of the present application. However, this application can be implemented in many different forms and is not limited to the embodiments described herein. Rather, these embodiments are provided to provide a thorough and comprehensive understanding of the disclosure of this application.

Figure 1:
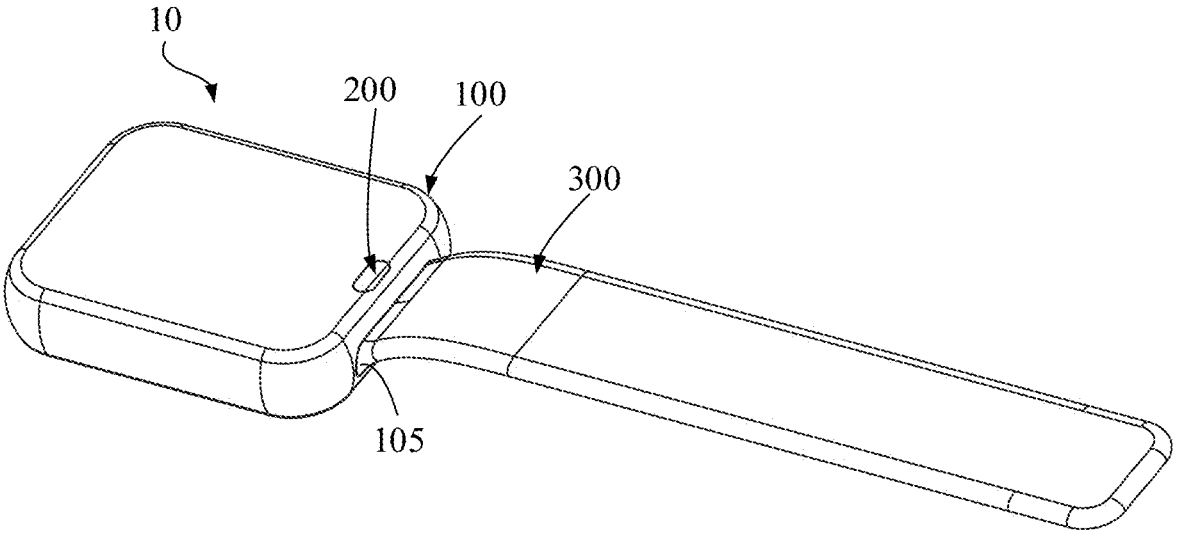
FIG. 1 is a perspective view of a wearable device according to an embodiment.

Referring to FIG. 1, the wearable device 10 includes a watchcase 100, a button 200, and a watchband 300. The watchcase 100 may be made of a non-metallic material such as plastic, rubber, silicone, wood or ceramic, and the watchcase 100 may also be made of a metallic material such as stainless steel, aluminum alloy, or magnesium alloy. A mounting space is formed inside the watchcase 100. In some embodiments, the wearable device 10 is a smart watch. The mounting space may be used to install electronic components such as a battery, a processor, a display screen, a biosensor, etc., but the display screen is not necessary, and may be omitted. The biosensor may be used to detect biological data such as heart rate, respiration rate, blood pressure, or body fat. In some embodiments, the biosensor may also be used to detect the state of movement, such as for step counting. In other embodiments, the wearable device 10 may be a sports watch or a conventional watch or the like, a common form of the sports watch is an electronic watch, and a common form of the conventional watch is a mechanical watch. In other embodiments, the wearable device 10 may also be a smart bracelet or the like.

Figure 2:
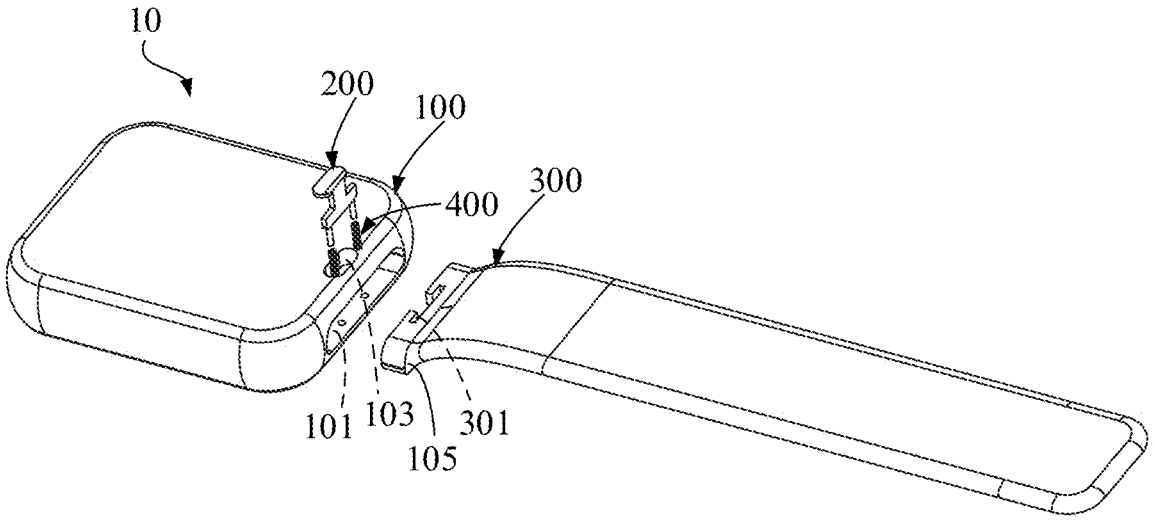
FIG. 2 is an exploded view of the wearable device shown in FIG. 1 from a perspective.

Referring to FIG. 2, the watchcase 100 is provided with a groove 101 for mounting the watchband 300, and the button 200 is provided in the groove 101 and is used for engaging and fixing the watchband 300 to the watchcase 100, or for releasing the watchband 300 to make the watchband 300 detach from the watchcase 100. In some embodiments, the watchband 300 is divided into two sections, one end of each of the two sections of the watchband 300 is connected to the watchcase 100, and the ends of the two sections of the watchband 300 facing away from the watchcase 100 may be fastened to form a receiving space, so that the wearable device 10 is worn on a user's wrist or forearm or other parts of the body through the watchband 300. In other embodiments, the watchband 300 may be a one-piece structure. The two ends of the watchband 300 are respectively connected to the watchcase 100. The watchband 300 may adjust the size of the receiving space through other structures to facilitate user wearing. This application uses one of the two sections of the watchband 300 as an example for description, but it can be understood that the structure disclosed in this application is also applicable to other forms of the watchband 300.

Figure 3:
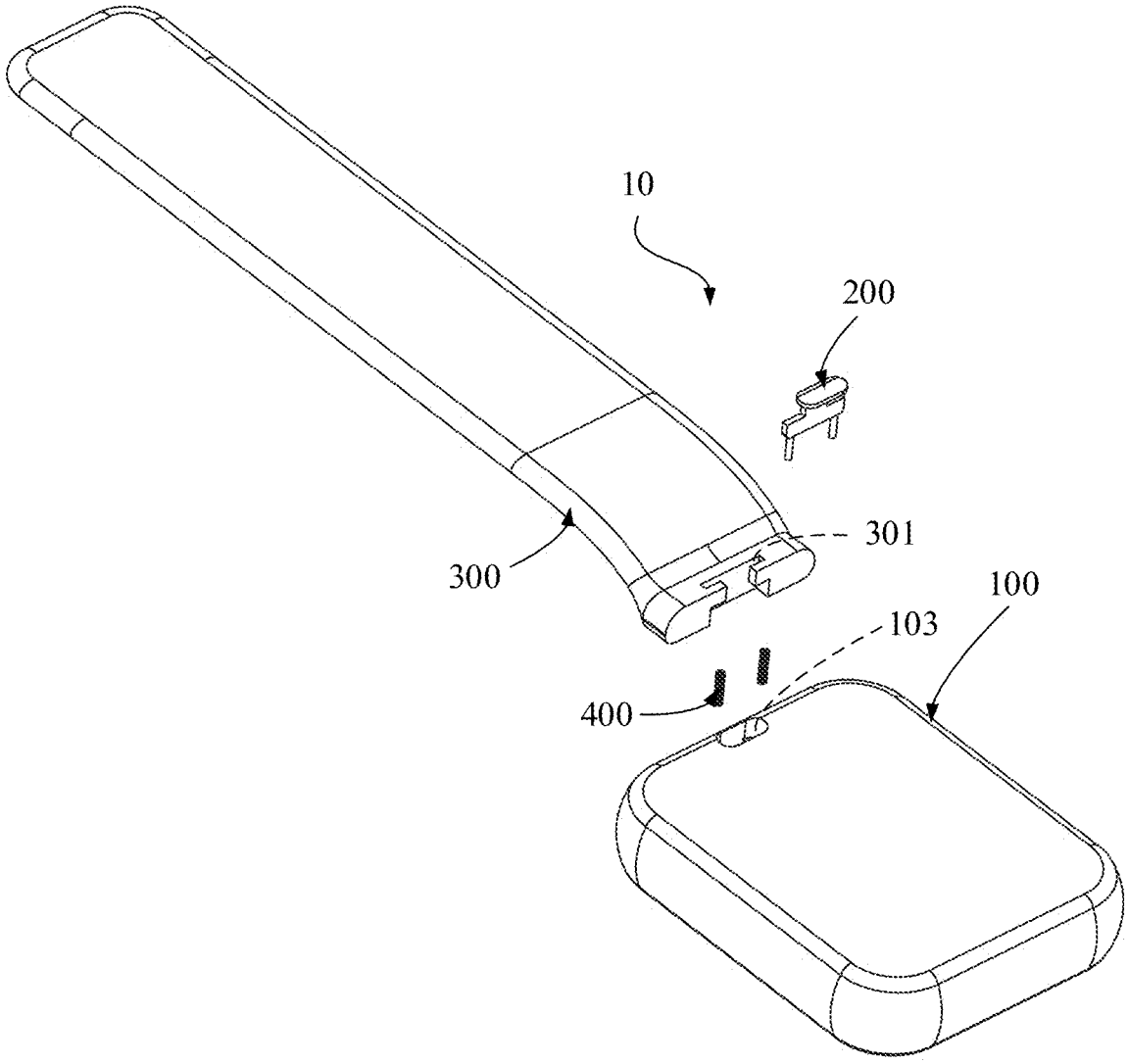
FIG. 3 is an exploded view of the wearable device shown in FIG. 2 from another perspective.
Figure 4:
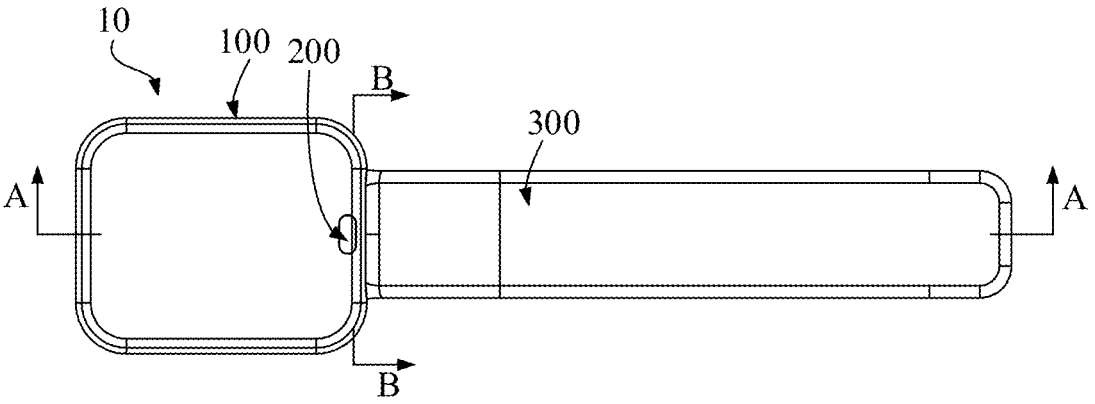
FIG. 4 is a front view of a button of the wearable device shown in FIG. 1 in a first position.
Figure 5:
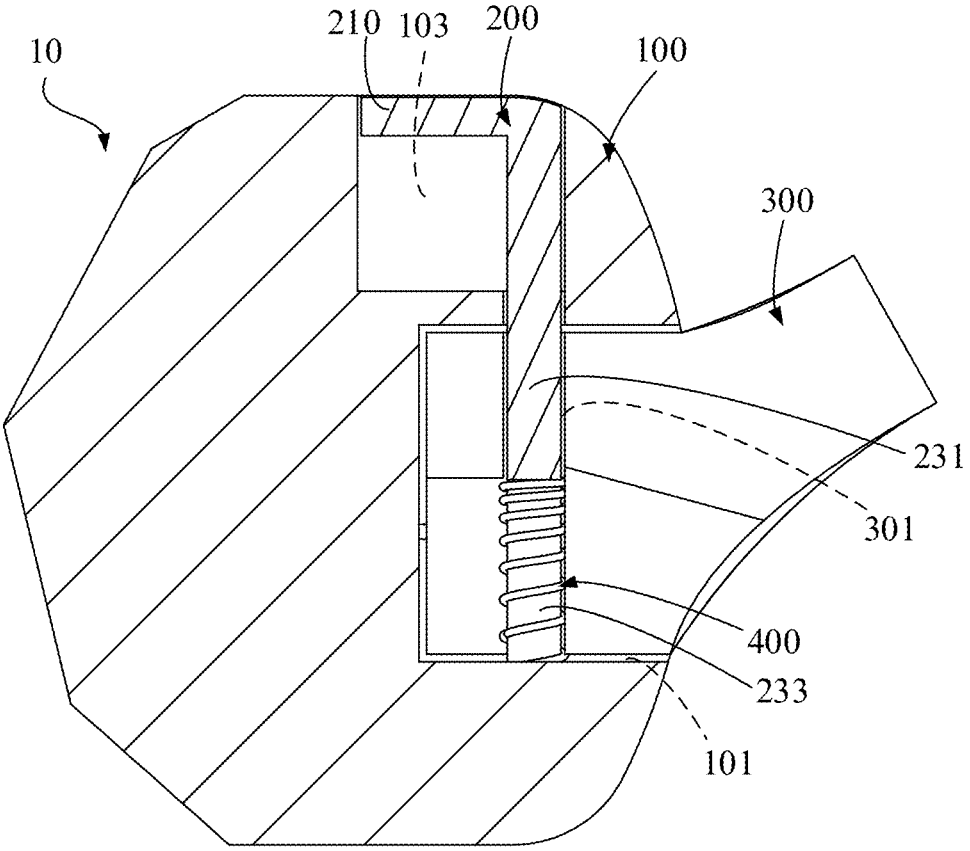
FIG. 5 is a cross-sectional view of the wearable device shown in FIG. 4 along A-A.
Figure 6:
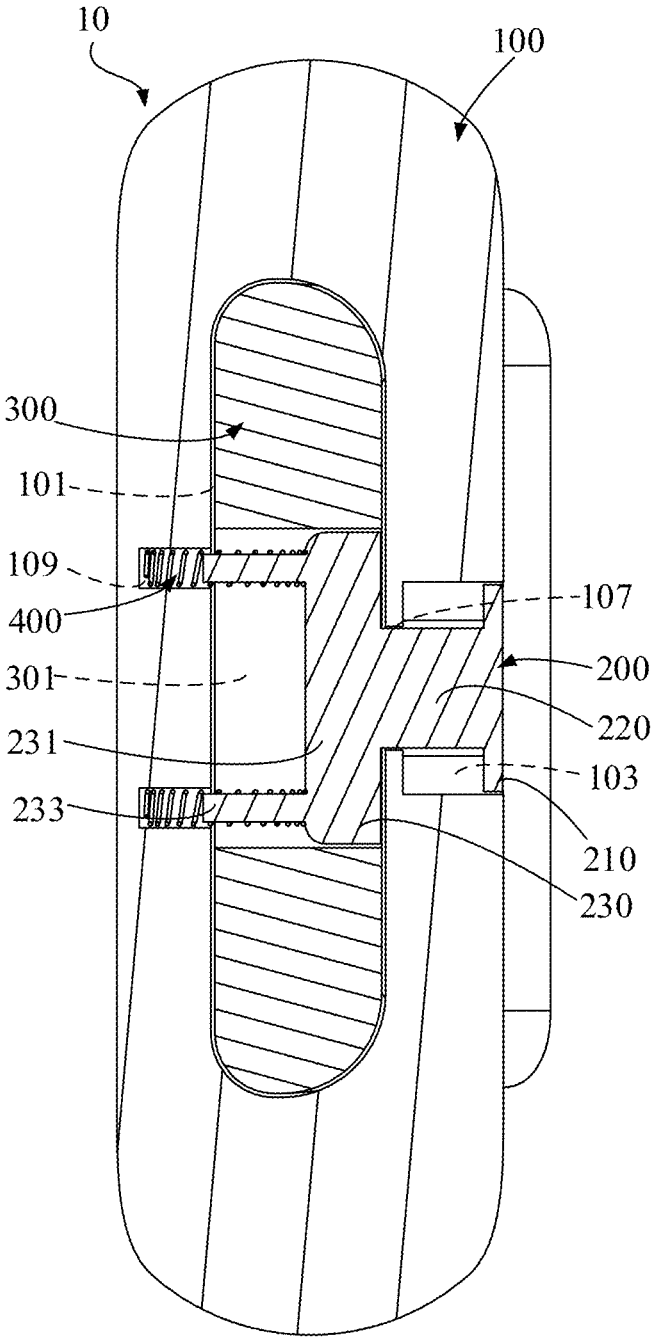
FIG. 6 is a cross-sectional view of the wearable device shown in FIG. 4 along B-B.
Figure 7:
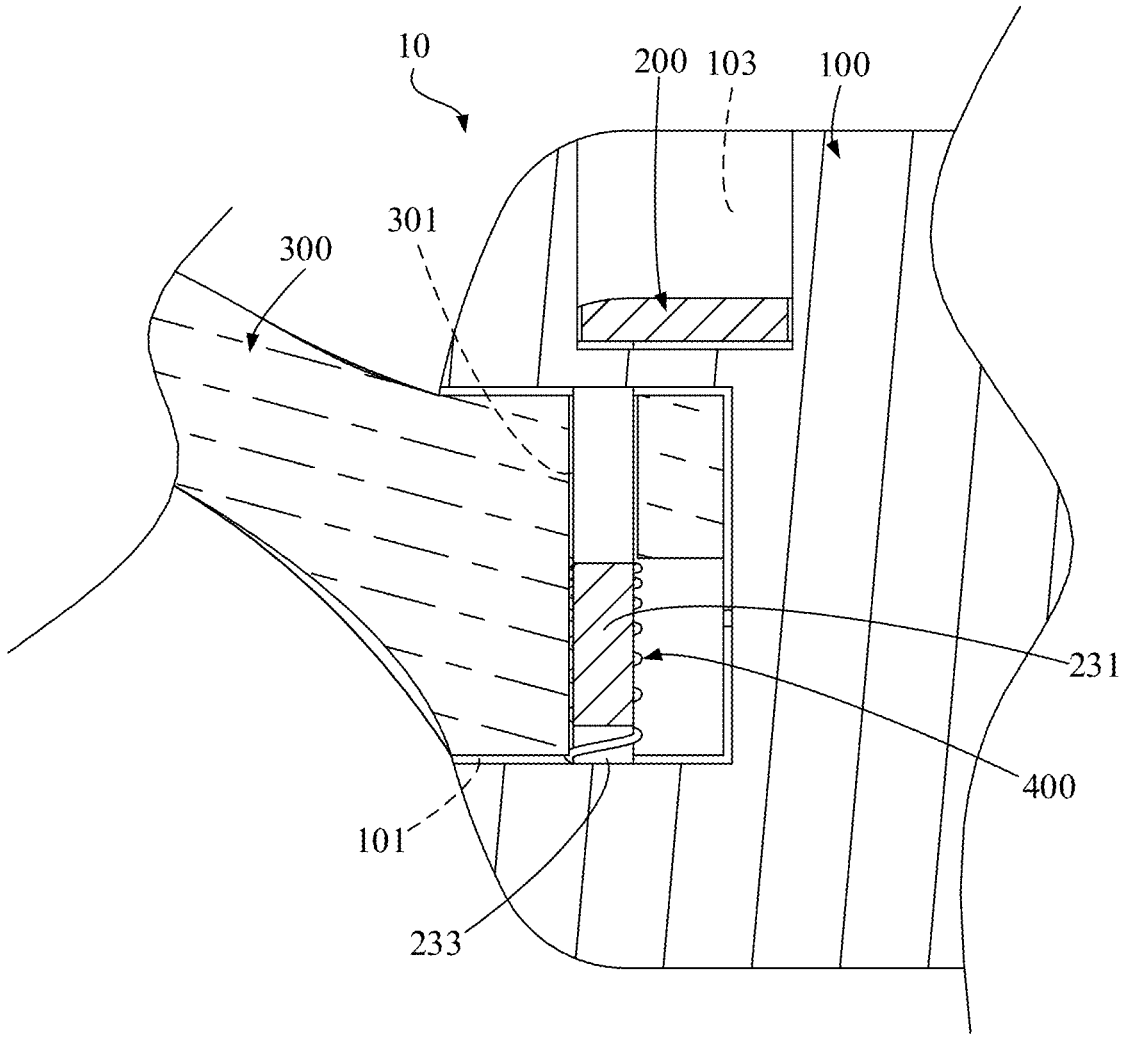
FIG. 7 is a cross-sectional view of a button of the wearable device in a second position according to an embodiment.
Figure 8:
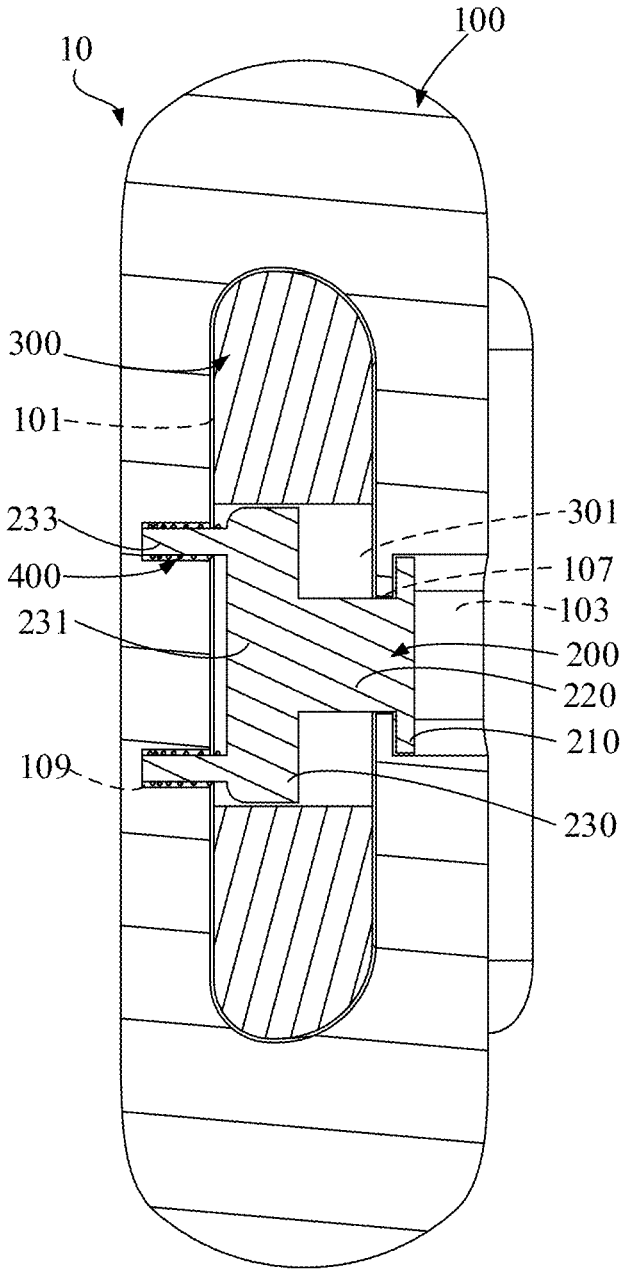
FIG. 8 is a cross-sectional view of another cross section of the button of the wearable device in the second position according to an embodiment.

Referring to FIG. 3, the end portion of the watchband 300 is provided with a clamping groove 301 extending to an edge of the watchband 300. The end where the clamping groove 301 is located may be received in the groove 101, and the button 200 can be moved to a first position and a second position relative to the watchcase 100. Referring to FIG. 4, FIG. 5 and FIG. 6, in the first position, the button 200 passes through the clamping groove 301 and engages the watchband 300 with the watchcase 100. Referring to FIGS. 7 and 8, in the second position, the button 200 can be withdrawn from the clamping groove 301 to enable the watchband 300 to be detached from the watchcase 100. Further, the watchcase 100 can be provided with a mounting groove 103 communicating with the groove 101. Apart of a structure of the button 200 is received in the mounting groove 103 and exposed. The button 200 is inserted through the groove 101 and the mounting groove 103 and can telescopically extend through the mounting groove 103 to switch between the first position and the second position. Further, referring to FIG. 2, in some embodiments, a groove wall of the mounting groove 103 can be closed in the circumferential direction, and in the first position (e.g. when the watchband 300 is engaged with the watchcase 100), the exposed end face of the button 200 can be flush with the outer surface of the watchcase 100, as shown in FIG. 5. When the button 200 is in the first position, the wearable device 10 can have a relatively high appearance integrity, so as to improve the appearance characteristics of the wearable device 10. Further, referring to FIG. 1, in some embodiments, the end where the clamping groove 301 of the watchband 300 is located can form a curved surface 105 on a side facing away from the watchcase 100, and in the first position, a peripheral edge of the curved surface 105 and a circumferential edge of the groove wall of the groove 101 are joined to form a continuous contoured surface. This structure can also make the wearable device 10 have a relatively high appearance integrity, thereby improving the appearance characteristics of the wearable device 10.

Since the watchband 300 has an elongated shape in the flattened state, it has a length direction, a width direction, and a thickness direction. These directions can be intuitively observed, and then the positions of the clamping groove 301 and the mounting groove 103 can be clearly described by introducing these directions. Specifically, in some embodiments, referring to FIG. 3, the clamping groove 301 extends to the edge of the watchband 300 in the length direction of the watchband 300, the button 200 moves in the thickness direction of the watchband 300, the watchband 300 can be mounted to the groove 101 in the length direction and is engaged with the watchcase 100 by the button 200, and the button 200 can be retracted into the mounting groove 103 along the thickness direction of the watchband 300 so that the watchband 300 can be detached from the watchcase 100. However, it can be understood that the mounting groove 103 can be alternatively positioned. For example, the button 200 may be provided in the groove 101 and exposed from the watchband 300 when the watchband 300 is engaged with the watchcase 100. The movement of the button 200 along the thickness direction of the watchband 300 should also be broadly understood. For example, the movement direction of the button 200 may be at a certain inclination angle with the thickness direction of the watchband 300. Further, it can be understood that the length, width, and thickness directions of the watchband 300 are introduced to more clearly describe the scheme of the present application. The structure of the clamping groove 301 and the movement direction of the button 200 may be changed in other forms, which are not listed here one by one.

In the aforementioned wearable device 10, since the button 200 can be moved and retracted in the thickness direction of the watchband 300, the exposed end face of the button 200 can be set relatively large to allow the user to apply force. The button 200 can be moved to the first position and the second position relative to the watchcase 100, such that it engages the watchband 300 with the watchcase 100 in the first position, and detaches the watchband 300 from the watchcase 100 in the second position. Therefore, the wearable device 10 having the above structure can easily detach the watchband 300 from the watchcase 100. For example, for the wearable device 10 having the above structure, the user can purchase a plurality of watchbands 300 and easily replace them to suit more diverse usage scenarios. For example, a fashionable style watchband 300 can be worn in sports or daily use, and a formal and matching watchband 300 can be worn in the workplace.

Figure 9:
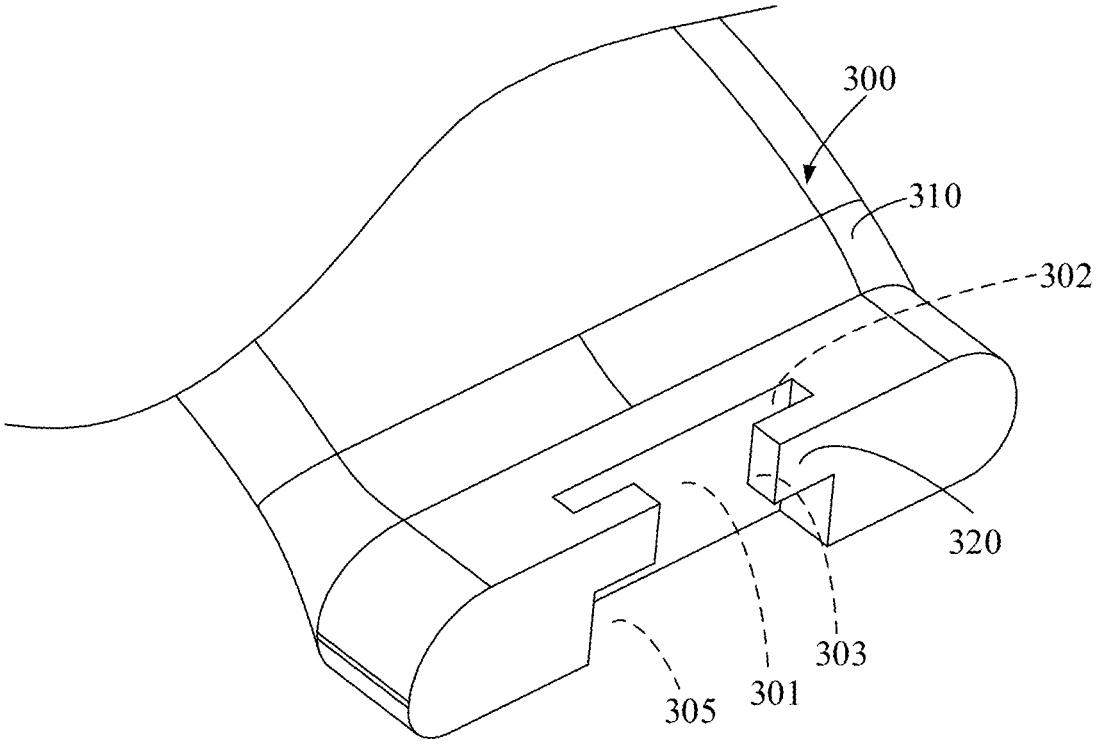
FIG. 9 is a perspective view of a watchband of the wearable device shown in FIG. 3.

Referring to FIG. 9, the watchband 300 includes a main body 310 and a stopper 320, and the clamping groove 301 includes a bottom groove 302 and an opening 303 communicating with the bottom groove 302. The bottom groove 302 is provided on the main body 310 and the bottom groove 302 extends to opposite sides of the main body 310 in the thickness direction of the watchband 300. The stopper 320 extends from the groove wall of the bottom groove 302 to form an opening 303 communicating with the bottom groove 302, and the opening 303 extends to the edge of the stopper 320 in the length direction of the watchband 300. In the width direction of the watchband 300, the width of the opening 303 is smaller than the width of the bottom groove 302. When the button 200 is in the first position so that the watchband 300 is engaged with the watchcase 100, the stopper 320 restricts the watchband 300 from coming out of the clamping groove 301 in the length direction. After the button 200 is retracted into the mounting groove 103 to the second position, the watchband 300 can be pulled in a direction away from the watchcase 100 along the length direction, and the button 200 can exit the clamping groove 301 through the opening 303 along the length direction of the watchband 300, thereby causing the watchband 300 to be detached from the watchcase 100 along its length direction. In some embodiments, there are two stoppers 320, and the two stoppers 320 extend opposite to form the opening 303 communicating with the bottom groove 302, and in the width direction of the watchband 300, the width of the opening 303 is smaller than the width of the bottom groove 302. In other embodiments, one of the stoppers 320 may be omitted, that is, one stopper 320 may extend from the groove wall of the bottom groove 302 to form the opening 303.

Figure 10:
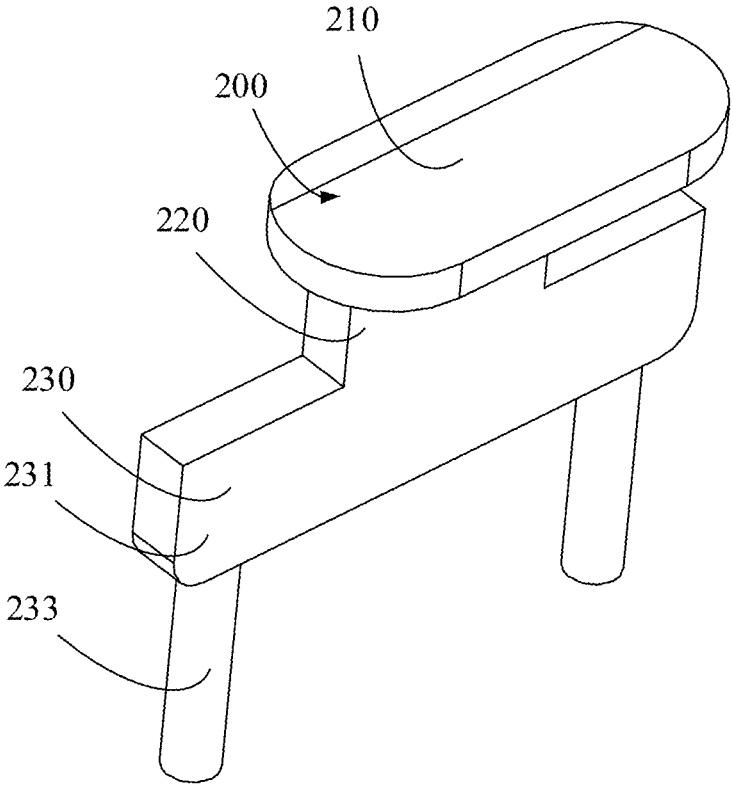
FIG. 10 is a perspective view of the button of the wearable device shown in FIG. 3.

Referring to FIG. 10, the button 200 includes a pressing plate 210, a connecting portion 220, and a limiting portion 230. The pressing plate 210 and the limiting portion 230 are respectively connected to both ends of the connecting portion 220. In conjunction with FIG. 5, the pressing plate 210 can be exposed from the mounting groove 103, and in the first position, the exposed end surface of the pressure plate 210 can be flush with the surface of the watchcase 100. With reference to FIGS. 9 and 10, in the width direction of the watchband 300, the maximum width of the limiting portion 230 is greater than the maximum width of the connecting portion 220, and the width of the limiting portion 230 is greater than the width of the opening 303. When the button 200 is in the first position so that the watchband 300 is engaged with the watchcase 100, the stopper 320 restricts the limiting portion 230 from coming out of the clamping groove 301 along the length direction of the watchband 300. After the button 200 is retracted into the mounting groove 103 to the second position, the connecting portion 220 can exit the clamping groove 301 through the opening 303.

Further, referring to FIG. 6, in some embodiments, the groove bottom of the mounting groove 103 can be provided with a channel 107 connecting the mounting groove 103 and the groove 101, and the connecting portion 220 passes through the channel 107. In the width direction of the watchband 300, the maximum width of the pressure plate 210 and the maximum width of the limiting portion 230 may be larger than the maximum width of the channel 107. When the button 200 is in the first position, the limiting portion 230 may abut against the side of the channel 107 facing away from the mounting groove 103. With reference to FIG. 8, when the button 200 is in the second position, the pressing plate 210 may abut against the side of the channel 107 facing away from the groove 101. This arrangement can use the channel 107 to guide and limit the movement of the connecting portion 220, but it can be understood that the setting of the channel 107 is not necessary. For example, the mounting groove 103 may directly penetrate the groove 101. Further, referring to FIG. 10, in some embodiments, in the length direction of the watchband 300, one side of the pressing plate 210 is flush with one end surface of the connecting portion 220, and the other side of the pressing plate 210 protrudes from the other end surface of the connecting portion 220. With this structure of the button 200, the cross-sectional area of the channel 107 may be set to be relatively small, and a part of the side wall of the channel 107 and a part of the side wall of the mounting groove 103 may be coplanar. The channel 107 can thereby be more easily manufactured, and the structural strength of the groove bottom of the mounting groove 103 can be substantially maintained as compared to other embodiments described herein.

Further, referring to FIG. 9, in the thickness direction of the watchband 300, one side of the stopper 320 is flush with the surface of the main body 310, and the other side of the stopper 320 opposite to the one side and the main body 310 form a notch 305 communicating with the bottom groove 302 and the opening 303. In the width direction of the watchband 300, the width of the limiting portion 230 is less than or equal to the width of the notch 305. After the button 200 is retracted into the mounting groove 103 to the second position, the limiting portion 230 can exit the clamping groove 301 from the notch 305. The setting of the notch 305 can shorten the distance between the first position and the second position, that is, the stroke of the button 200 can be appropriately shortened to improve the convenience of installation and removal. For example, when the stroke of the button 200 is short and the area of the pressing plate 210 is relatively large, the user can directly press the pressing plate 210 with the finger to the second position, so that the watchband 300 can be easily detached from the watchcase 100.

Referring to FIGS. 6 and 8, the wearable device 10 includes an elastic member 400 extending along the thickness direction of the watchband 300. One end of the elastic member 400 abuts against the watchcase 100 and the other end abuts against the limiting portion 230. Further, referring to FIG. 8, the button 200 compresses the elastic member 400 in the second position. Referring to FIG. 6, when the button 200 is located at the first position so that the watchband 300 is engaged with the watchcase 100, the elastic member 400 can cause the limiting portion 230 to abut against the watchcase 100. The elastic member 400 can reset the button 200 from the second position to the first position, but the elastic member 400 is not necessary. For example, a wedge-shaped surface may be provided in the clamping groove 301 of the watchband 300 to push the button 200 back to the first position during the process of mounting the watchband 300 to the watchcase 100. In one embodiment, the elastic member 400 is a spring. In other embodiments, the elastic member 400 may be an elastic cylinder structure or an elastic sheet structure. Further, in some embodiments, when the button 200 is in the first position, the elastic member 400 is in a compressed state, and the elastic member 400 makes the limiting portion 230 abut against the groove wall of the groove 101, so that the button 200 is reliably fixed in the groove 101 and the mounting groove 103, and the watchband 300 is reliably limited in the watchcase 100 to prevent the button 200 from loosening easily.

Further, referring to FIG. 10, the limiting portion 230 includes a main body 231 and a protruding cylinder 233 connected to the main body 231. The protruding cylinder 233 extends along the thickness direction of the watchband 300. With reference to FIGS. 6 and 8, the elastic member 400 is sleeved on the protruding cylinder 233 and abuts against the main body 231. In the embodiment shown in FIG. 10, there are two protruding cylinders 233, and the two protruding cylinders 233 are respectively sleeved with the elastic members 400. This arrangement can improve the smoothness of the movement of the button 200. In other embodiments, the number of the protruding cylinders 233 may be one or three or more. Further, the groove wall of the groove 101 is provided with a receiving groove 109, and an end of the elastic member 400 remote from the main body 231 is received in the receiving groove 109 and abuts with the watchcase 100. When the button 200 is located at the first position to make the watch band 300 engage with the watchcase 100, an end of the protruding cylinder 233 away from the main body 231 is received in the receiving groove 109. This arrangement can provide guidance by the movement of the protruding cylinder 233 in the receiving groove 109 to make the button 200 move more smoothly.

The features of the embodiments described herein can be combined in various ways. In order to simplify the description, all possible combinations of the technical features in the above embodiments have not been described. However, as long as there is no contradiction in the combination of these technical features, such combination should be considered as the scope described in this specification.

The above-mentioned embodiments only express several implementation manners of the present application, and their descriptions are more specific and detailed, but they cannot be understood as a limitation on the scope of patent application. It should be noted that, for those of ordinary skill in the art, without departing from the concept of the present application, several modifications and improvements can be made, which all belong to the protection scope of the present application. Therefore, the protection scope of this application patent shall be subject to the appended claims.

What is claimed is:

1. A wearable device, comprising:

a watchcase provided with a mounting groove along a first direction perpendicular to a surface of the watchcase and provided with a groove along a second direction perpendicular to the first direction of the watchcase, the mounting groove and the groove being mutually communicated;

a watchband, wherein an end portion of the watchband is receivable in the groove, and the end portion is provided with a clamping groove extending along the first direction, and wherein the clamping groove comprises a groove bottom surface, and a first side wall and a second side wall opposite to each other, a first stopper and a second stopper respectively extend from the first side wall and the second side wall to an inside of the clamping groove, a first distance is spaced between the first stopper and the second stopper, and lengths of the first stopper and the second stopper along the first direction are less than a length of the end portion along the first direction, and lengths of the first stopper and the second stopper along the second direction are less than lengths of the first side wall and the second side wall along the second direction respectively; and a button passing through the mounting groove and the groove of the watchcase and the clamping groove of the watchband along the first direction, and being movable between a first position and a second position along the first direction, wherein in the first position, the button engages the watchband with the watchcase, and in the second position, the button is withdrawable from the clamping groove to enable the watchband to be detached from the watchcase.

2. The wearable device according to claim 1, wherein the wearable device further comprises an elastic member, a first end of the elastic member abuts against the watchcase, and a second end of the elastic member abuts against the button, and in the second position, the button compresses the elastic member.

3. The wearable device according to claim 2, wherein the button comprises a pressing plate, a connecting portion and a limiting portion, a lower surface of the pressing plate is connected to an end of the connecting portion, the other end of the connecting portion is connected to the limiting portion, the second end of the elastic member buts against the limiting portion of the button, a width of the connecting portion is smaller than a width of the limiting portion, and the width of the limiting portion is greater than the first distance between the first stopper and the second stopper.

4. The wearable device according to claim 3, wherein in the first position, the first stopper and the second stopper are configured to restrict the limiting portion from coming out of the clamping groove, and in the second position, the connecting portion is configured to exit the clamping groove from an opening between the first stopper and the second stopper.

5. The wearable device according to claim 4, wherein in the first direction, upper surfaces of the first stopper and the second stopper are flush with an upper surface of the end portion of the watchband, the width of the limiting portion being less than or equal to a width between the first side wall and the second side wall of the clamping groove.

6. The wearable device according to claim 4, wherein the limiting portion comprises a body and a protruding cylinder extending from the body, and the second end of the elastic member is sleeved on the protruding cylinder and abuts against the body.

7. The wearable device according to claim 6, wherein a groove wall of the groove of the watchcase opposite to the mounting groove is provided with a receiving hole, and the first end of the elastic member is received in the receiving hole and abuts against the watchcase.

8. The wearable device according to claim 7, wherein an end of the protruding cylinder away from the body is received in the receiving hole.

9. The wearable device according to claim 4, wherein a groove bottom of the mounting groove is provided with a channel for communicating the mounting groove and the groove, a maximum width of the channel being smaller than a maximum width of the mounting groove, a maximum width of the limiting portion being greater than the maximum width of the channel, and the connecting portion passing through the channel and being movable within the channel.

10. The wearable device according to claim 9, wherein in the second position, the elastic member is in a compressed state, and the elastic member causes the limiting portion to abut against a groove wall of the groove.

11. The wearable device according to claim 4, wherein in the first position, an upper surface of the pressing plate is flush with an upper surface of the end portion of the watchcase.

12. The wearable device according to claim 11, wherein in the second direction, one side of the pressing plate is flush with an end surface of one side of the connecting portion, and the other side of the pressing plate protrudes from an end surface of the other side of the connecting portion.

13. The wearable device according to claim 1, wherein the end portion of the watchband forms a curved surface on a side facing away from the watchcase, and in the first position, a circumferential edge of the curved surface is joined to a circumferential edge of a groove wall of the groove to form a continuous contoured surface.

14. A watchband, wherein an end portion of the watchband is provided with a clamping groove extending along a first direction of the watchband, and wherein the clamping groove comprises a groove bottom surface, and a first side wall and a second side wall opposite to each other, a first stopper and a second stopper respectively extend from the first side wall and the second side wall to an inside of the clamping groove, a first distance is spaced between the first stopper and the second stopper, and lengths of the first stopper and the second stopper along the first direction are less than a length of the end portion along the first direction, and lengths of the first stopper and the second stopper along a second direction of the watchband are less than lengths of the first side wall and the second side wall along the second direction respectively.

15. The watchband according to claim 14, wherein the end portion of the watchband is configured to engage in a groove of a watchcase through a button.

* * * * *